US008336567B2

(12) United States Patent
Su

(10) Patent No.: US 8,336,567 B2
(45) Date of Patent: Dec. 25, 2012

(54) OPERATION SYSTEM FOR UMBRELLAS

(76) Inventor: Ping-Tung Su, Hsin-Chu (TW)

( * ) Notice: Subject to any disclaimer, the term of this patent is extended or adjusted under 35 U.S.C. 154(b) by 0 days.

(21) Appl. No.: 12/929,747

(22) Filed: Feb. 14, 2011

(65) Prior Publication Data

US 2012/0204920 A1 Aug. 16, 2012

(51) Int. Cl.
*A45B 25/08* (2006.01)

(52) U.S. Cl. ..... 135/39; 135/28; 135/38

(58) Field of Classification Search ..... 135/37–41
See application file for complete search history.

(56) References Cited

U.S. PATENT DOCUMENTS 694,624 A * 3/1902 Evans ..... 135/39
5,287,869 A * 2/1994 Wu ..... 135/25.1
5,387,048 A * 2/1995 Kuo ..... 403/109.3
6,006,477 A * 12/1999 Ko ..... 135/25.4
6,758,229 B2 * 7/2004 Wang ..... 135/41
6,941,960 B2 * 9/2005 Huang ..... 135/41
7,089,950 B2 * 8/2006 Lin et al. ..... 135/38
7,204,261 B1 * 4/2007 Wu ..... 135/28
7,225,821 B2 * 6/2007 Su ..... 135/38
7,281,542 B2 * 10/2007 Ko ..... 135/39
2003/0019513 A1 * 1/2003 Lin et al. ..... 135/28
2005/0194027 A1 * 9/2005 Ko ..... 135/39

* cited by examiner

*Primary Examiner* — Noah Chandler Hawk

(57) ABSTRACT

An operation system for umbrellas includes a multiple-section shaft with a top cap connected to a top thereof and the top cap has a first extension which includes a flexible part formed thereto. A protrusion extends from a distal end of the flexible part. A runner is movably mounted to the shaft and the first extension. The runner has a second extension which has a positioning hole so as to receive the protrusion to stop the runner from moving downward. A hollow sleeve is movably mounted to the second extension and drives the runner to move along the shaft. The sleeve has a compressing member to compress the protrusion inward to disengage the protrusion from the positioning hole when folding the umbrella.

10 Claims, 10 Drawing Sheets

OPERATION SYSTEM FOR UMBRELLAS

BACKGROUND OF THE INVENTION (1) Field of the Invention

The present invention relates to an operation system for an umbrella, and more particularly, to an operation system for a multiple-section umbrella and requires no button spring.

(2) Description of the Prior Art

A conventional operation system for a multiple-section umbrella 100 is shown in FIG. 9 and generally includes a button spring 102 retractably protrudes out from a slot 101*a* defined through the wall of the shaft of the umbrella 100. The runner 103 is stopped by its bottom to maintain the position of the runner 103 when the umbrella 100 is opened. However, the shaft 101 of the umbrella 100 has to make the slot 101*a* so as to receive the button spring 102. The movement of the button spring 102 easily hurt the user's finger or the shaft 101 is damaged if the button spring 102 is mis-operated.

Another improved umbrella 200 is developed and disclosed in FIG. 10. A top end piece 202 is connected to the top of the shaft 201 and a runner 203 is movably mounted to the shaft 201. The top end piece 202 includes a clamp plate 202*a* extending downward therefrom and the lower end of the clamp plate 202*a* slightly extends outward. A protrusion 202*b* extends outward from the clamp plate 202*a*. The runner 203 has a recess 203*a* defined transversely in a middle portion thereof and a shoulder 203*b* is formed at the top periphery of the recess 203*a*. When the runner 203 moves upward, the protrusion 202*b* of the clamp plate 202*a* of the top end piece 202 is engaged with the shoulder 203*b* to keep the umbrella opened and the protrusion 202*b* is exposed from the recess 203*a*. When folding the umbrella, the user pushes the protrusion 202*b* to remove the runner 203 from the clamp plate 202*a* so that the umbrella is folded.

FIG. 11 shows yet another improved umbrella 300 which includes a top end piece 303 connected to the top of the shaft 301 and a resilient member 303*a* is connected to the top end piece 303, and a hook 303*b* is connected to the lower end of the resilient member 303*a*. The runner 302 is located below the hook 303*b* and has a notch 302*a*. A ring 302*b* is mounted to the runner 302 so that when the runner 302 moves upward, the resilient member 303*a* makes the hook 303*b* to be hooked with the ring 302*b* of the notch 302*a* so that the umbrella is kept to opened status. When folding the umbrella, the hook 303*b* is pushed to separate the runner 302 from the resilient member 303*a*.

FIG. 12 shows yet another improved umbrella 400 which includes a top end piece 402 connected to the top of the shaft 401 and a resilient member 402*a* is connected to the extension portion of the top end piece 402. When the runner 403 moves upward, the resilient member 402*a* is engaged with the underside of the runner 403 to keep the umbrella to be opened. When folding the umbrella, the resilient member 402*a* is pushed to separate the runner 403 from the resilient member 402*a* of the top end piece 402.

All of the three improved operation systems do not include the slot defined in the shaft, but the user still has to push the protrusion/resilient member to fold the umbrella. The action is inconvenient to the users because when pushing the protrusion/resilient member, the user's finger might be injured by the movement of the protrusion/resilient member, or the clamp plate or the protrusion/resilient member may be damaged.

FIGS. 13 and 14 show a further improved umbrella 500, wherein the runner 502 is movably mounted to the shaft 501 and includes a operation member 503 connected to the runner 502. The shaft 501 includes shoulders 501*a* protruding therefrom. The runner 502 has engaging members 502*a* on two sides thereof, which are engaged with the shoulders 501*a* when the moving the operation member 503 together with the runner 502 to keep the umbrella 500 to be opened. When folding the, umbrella 500, the operation member 503 is pulled downward, the two engaging members 502*a* are disengaged from the shoulders 501*a*, and the runner 502 moves downward to fold the umbrella 500.

Although there is no protrusion or resilient member to be pushed inward, the engagement between the engaging members 502*a* and the shoulders 501*a* is not secured enough, especially when the umbrella is used in a windy day or the umbrella shakes, the engaging members 502*a* are easily disengaged from the shoulders 501*a*. Such structure is restricted to be used for umbrella with a single shaft, and cannot be used to multiple-section shaft. The multiple sections have different inner diameters so that the engaging members 502*a* are difficult to be engaged with the small-diameter section of the shaft. The inner diameter of the runner cannot shrink along with the change of the multiple sections of the shaft so that the inner diameter of the runner has to be larger than the diameter of the largest section of the shaft, so that when the runner moves to the narrow section, the engagement between the shoulders and the engaging members will be too weak to hold the opened umbrella.

The present invention intends to provide an operation system for umbrellas wherein the system does not include any part needed to be pushed inward to fold the umbrella.

SUMMARY OF THE INVENTION

The present invention relates to an operation system for umbrellas and comprises a shaft including multiple sections. A top cap is connected to a top of the shaft and has a first extension. The first extension has a flexible part formed thereto and a protrusion extends from a distal end of the flexible part. A runner is movably mounted to the shaft and the first extension. The runner has a second extension extending downward therefrom and a positioning hole is defined through a wall of the second extension. The protrusion is engaged with the positioning hole to stop the runner from moving downward. A hollow sleeve is movably mounted to the second extension and drives the runner to move along the shaft. The sleeve has a compressing member located at an inner periphery thereof so as to compress the protrusion inward to disengage the protrusion from the positioning hole.

When folding the umbrella, the user simply moving the sleeve downward to push the protrusions inward so that the runner can be moved downward along the shaft to fold the umbrella.

The primary object of the present invention is to provide an operation system for an umbrella and the finger of the user is not injured by operation of the operation system.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
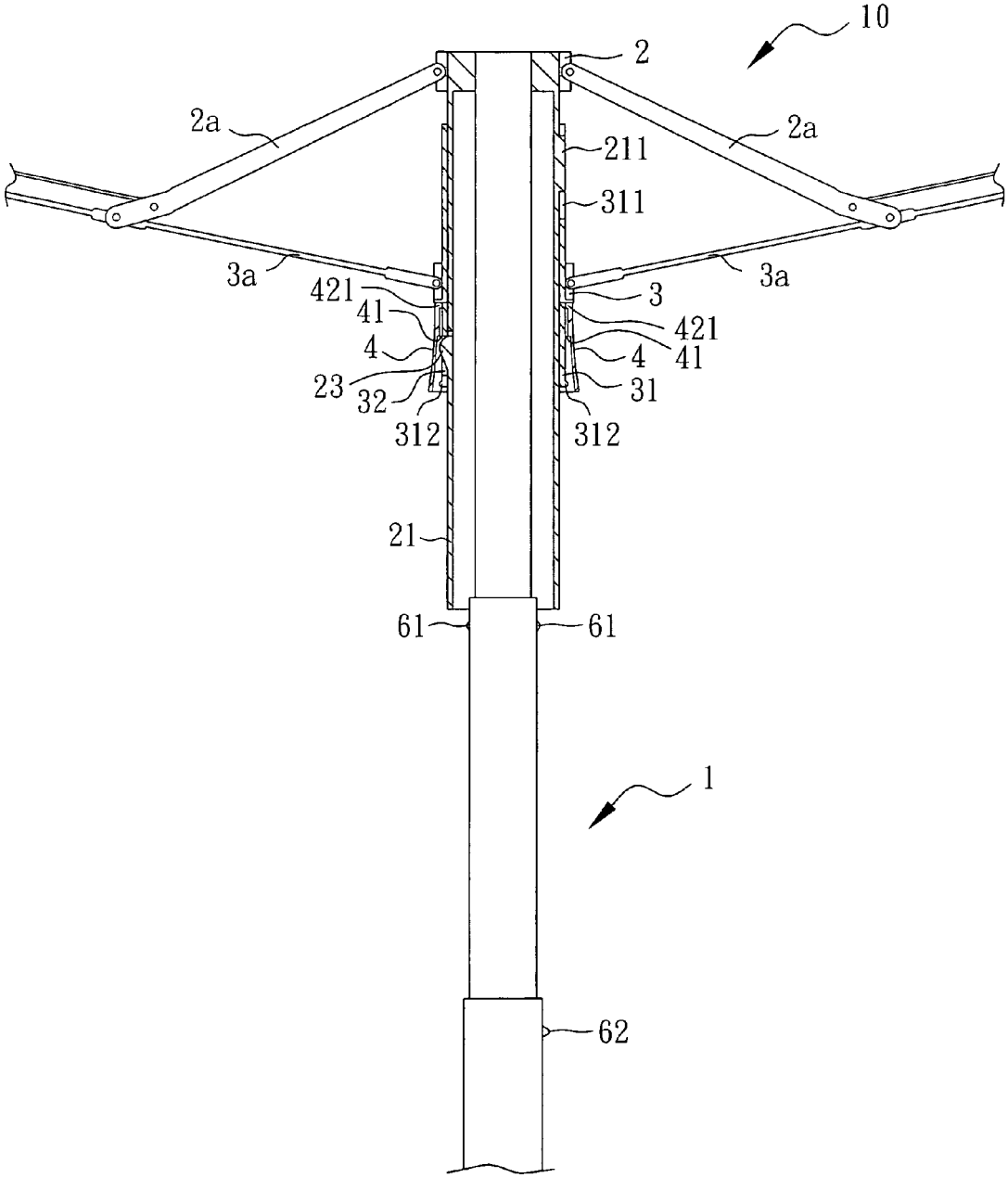
FIG. 1 is a cross sectional view to show the operation system of the umbrella of the present invention.
Figure 2:
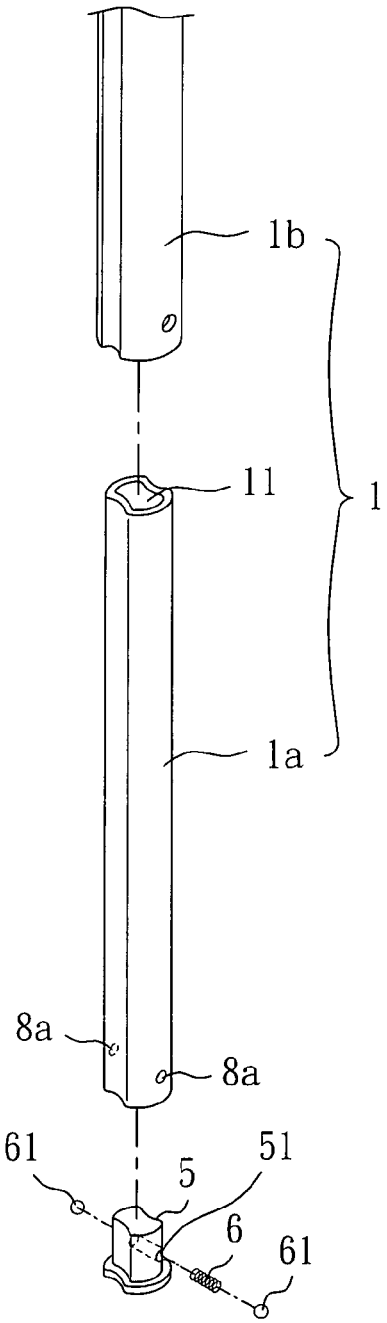
FIG. 2 is an exploded view to show the first embodiment of the sections of the shaft of the operation system of the umbrella of the present invention.

Referring to FIG. 1, the operation system of an umbrella 10 of the present invention comprises a shaft 1 including multiple sections, a top cap 2 is connected to a top of the shaft 1 and pivotably connected to ribs 2*a*. A runner 3 is movably mounted to the shaft 1 and pivotably connected to stretchers 3*a*. When the runner 3 is moved upward toward the top cap 2, the umbrella is opened. The shaft 1 is composed of multiple sections which have different diameter and made by metal. In this embodiment, the shaft 1 includes three sections, however, more than three sections are also available. As shown in FIG. 2, the shaft 1 includes a first section 1*a* and a second section 1*b*. The first and second sections 1*a*, 1*b* each includes a passage 11 defined therethrough. A first end piece 5 is inserted into the first section 1*a* and has a reception hole 51. A spring 6 is located in the reception hole 51 and two positioning beads 61 are located on two ends of the spring 6. In this embodiment, the positioning beads 61 are two steel beads. Each of the first and second sections 1*a*, 1*b* includes positioning holes 8*a*, the two positioning beads 61 are removably engaged with the positioning holes 8*a*.

Figure 3:
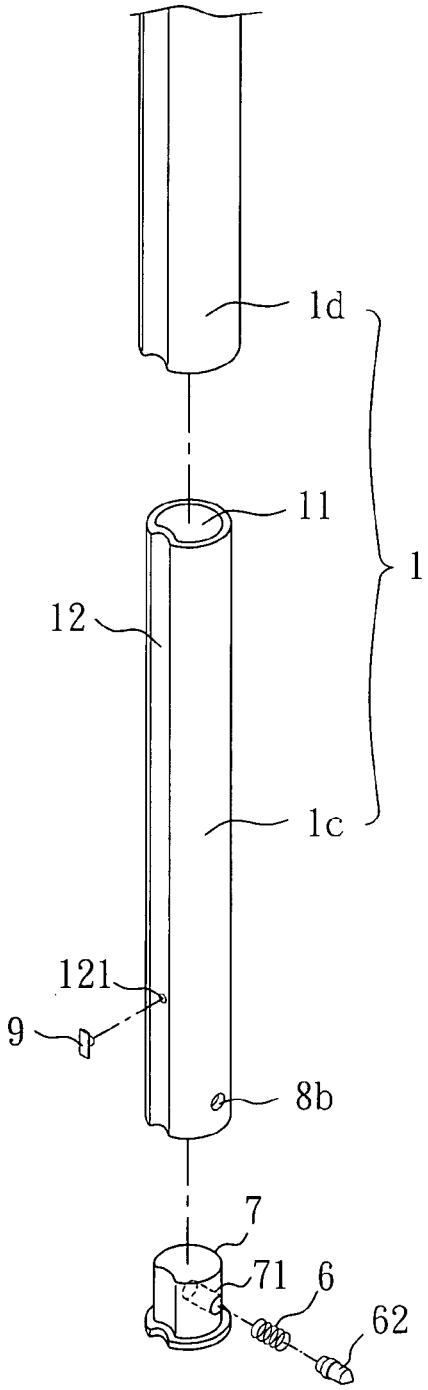
FIG. 3 is an exploded view to show the second embodiment of the sections of the shaft of the operation system of the umbrella of the present invention.

FIG. 3 which shows a second embodiment of the shaft 1, wherein the shaft 1 includes a third section 1*c* and a fourth section 1*d*. A second end piece 7 is inserted into the third section 1*c* and has a reception hole 71. A spring 6 is located in the reception hole 71 and a positioning member 62 is located at one end of the spring 6. Each of the third and fourth sections 1*c*, 1*d* includes positioning holes 8*b*. The positioning member 62 is removably engaged with the positioning holes 8*b*.

Each of the third and fourth sections 1*c*, 1*d* has two grooves 12 axially defined in an outer surface thereof and a through hole 121 is defined through a wall of the third section 1*c*. A stop member 9 is engaged with the through hole 121. The stop member 9 prevents the third and fourth sections 1*c*, 1*d* from being separated from each other.

Figure 4:
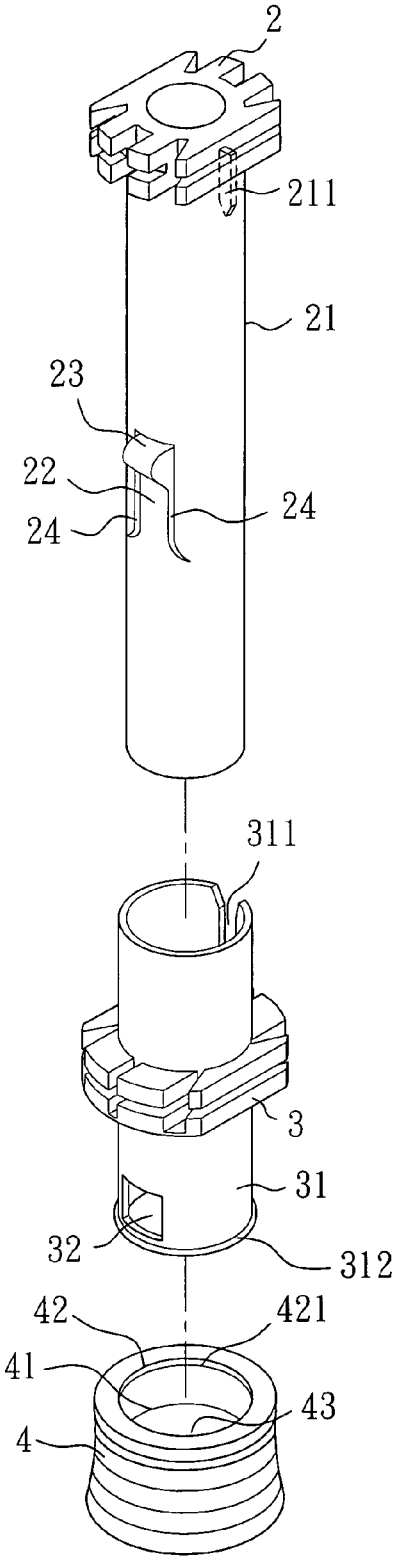
FIG. 4 is an exploded view to show the top cap, the runner and the sleeve of the operation system of the umbrella of the present invention.
Figure 5:
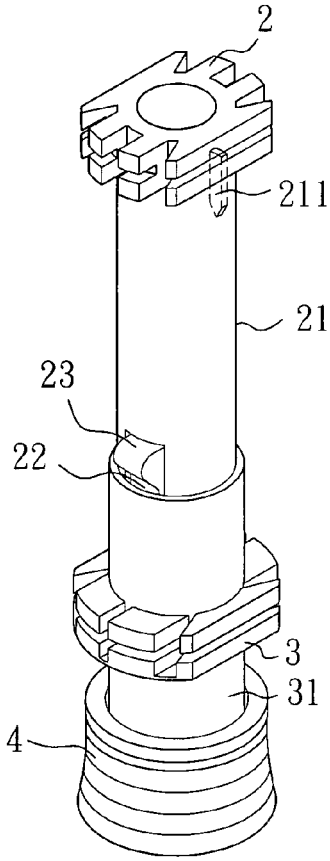
FIG. 5 is a perspective view to show the assembly of the top cap, the runner and the sleeve of the operation system of the umbrella of the present invention.
Figure 6:
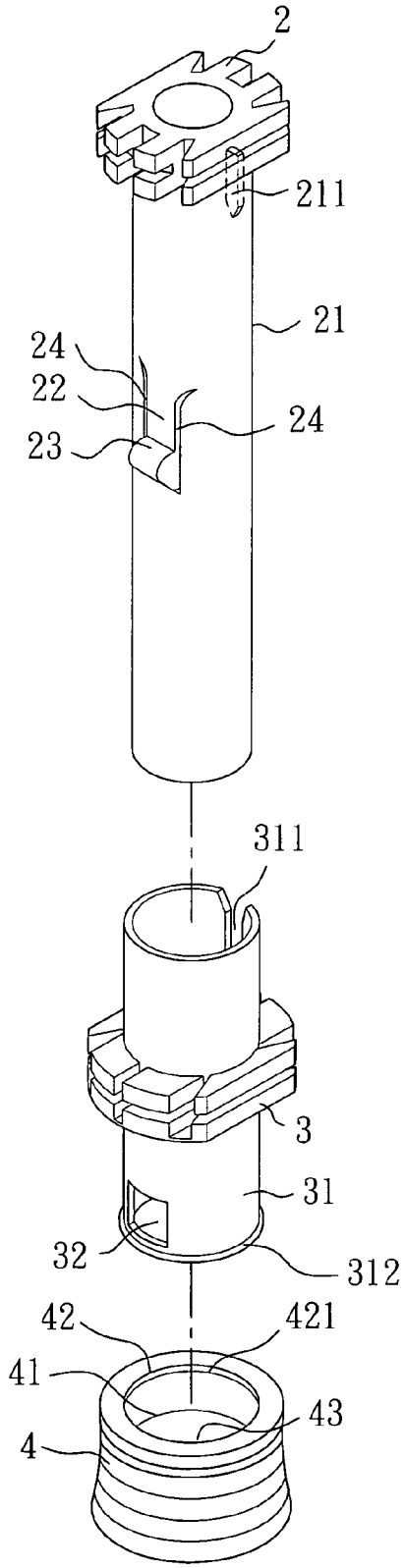
FIG. 6 shows another embodiment of the flexible part of the first extension of the present invention.

As shown in FIGS. 4 and 5, the top cap 2 has a first extension 21 extending downward therefrom and the first extension 21 has a flexible part 22 formed thereto. An inverted U-shaped gap 24 is defined between the flexible part 22 and a wall of the first extension 21. A protrusion 23 extends from a distal end of the flexible part 22. In this embodiment, the flexible part 22 is integrally formed with the first extension 21. The gap 24 can also be U-shaped as shown in FIG. 6.

The runner 3 is movably mounted to the shaft 1 and the first extension 21 and has a second extension 31 extending downward therefrom. A positioning hole 32 is defined through a wall of the second extension 31 and the protrusion 23 is engaged with the positioning hole 32 to stop the runner 3 from moving downward when the umbrella is opened. The first extension 21 has a guide member 211 located axially on an outer periphery thereof and the second extension 31 has a guide slot 311 defined therein which received the guide member 211 to guide the runner 3 to move linearly.

A hollow sleeve 4 is movably mounted to the second extension 31 and drives the runner 3 to move along the shaft 1. The sleeve 4 has a compressing member 41 located at an inner periphery thereof so as to compress the protrusion 23 inward to disengage the protrusion 23 from the positioning hole 32. In this embodiment, the compressing member 41 of the sleeve 4 is a stepped shoulder. The sleeve 4 has a first open end 42 and a second open end 43 which is wider than the first open end 42. The sleeve 4 has a tapered passage defined therethrough which communicates with the first and second open ends 42, 43. The first open end 42 of the sleeve 4 includes a boss 421 on an end surface thereof and the second extension 31 has an annular lip 312 on an underside thereof. The annular lip 312 is engaged with the boss 421 when the sleeve 4 is moved downward so that the sleeve 4 is not disengaged from the second extension 31.

Figure 7:
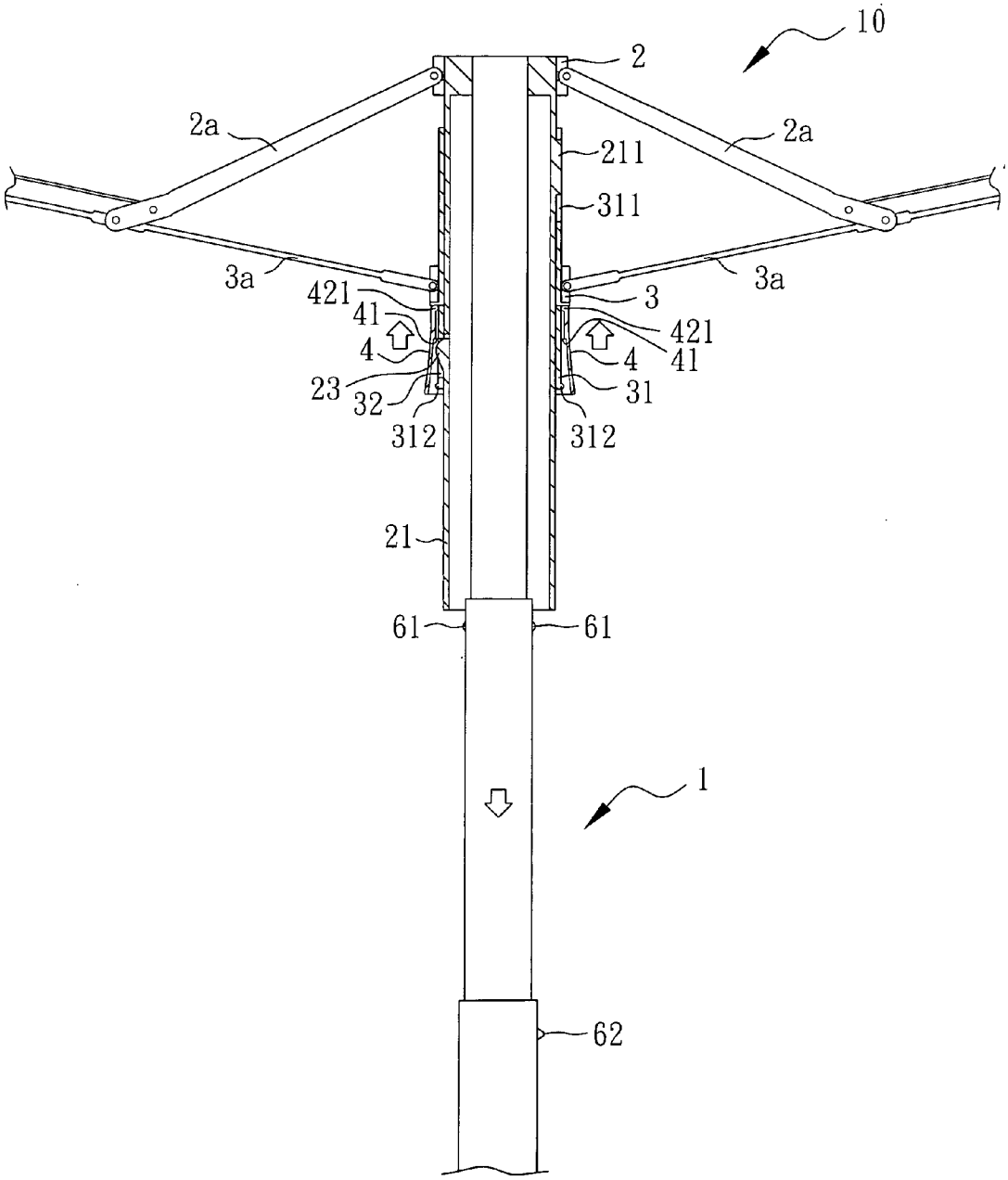
FIG. 7 is a cross sectional view of the umbrella which is opened.

As shown in FIG. 7, when opening the umbrella, the multiple sections are pulled to be a long shaft 1 and the sleeve 4 is moved upward to pivot the stretchers 3*a*, the runner 3 is moved along the first extension 21 to gradually open the umbrella. The guide slot 311 of the second extension 31 is then engaged with the guide member 211 of the first extension 21 to guide the runner 3 linearly and correctly. When the runner 3 reaches the desired position, the protrusion 23 on the top cap 2 is engaged with the positioning hole 32 of the runner 3 to hold the runner 3.

Figure 8:
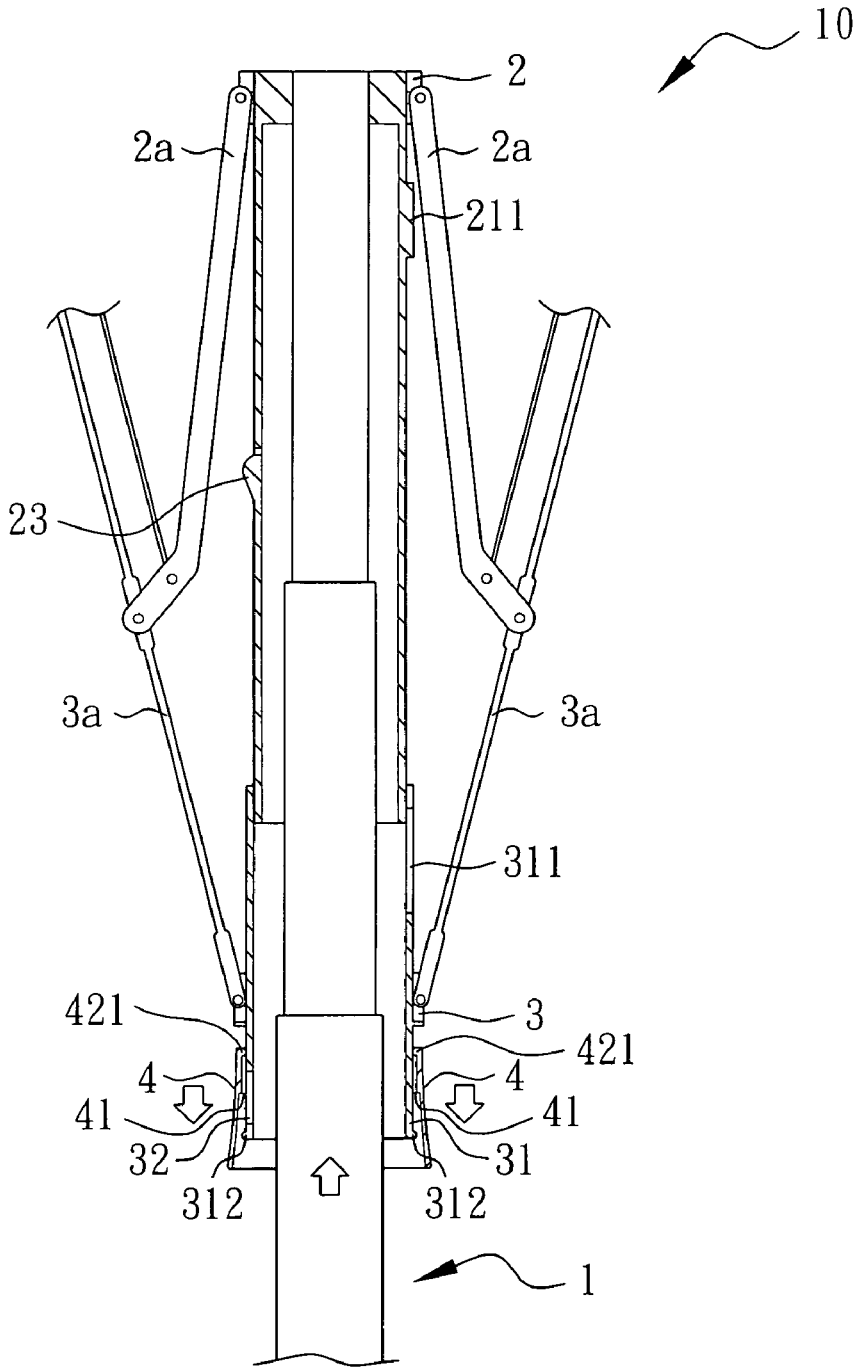
FIG. 8 shows that the umbrella is folded.
Figure 9:
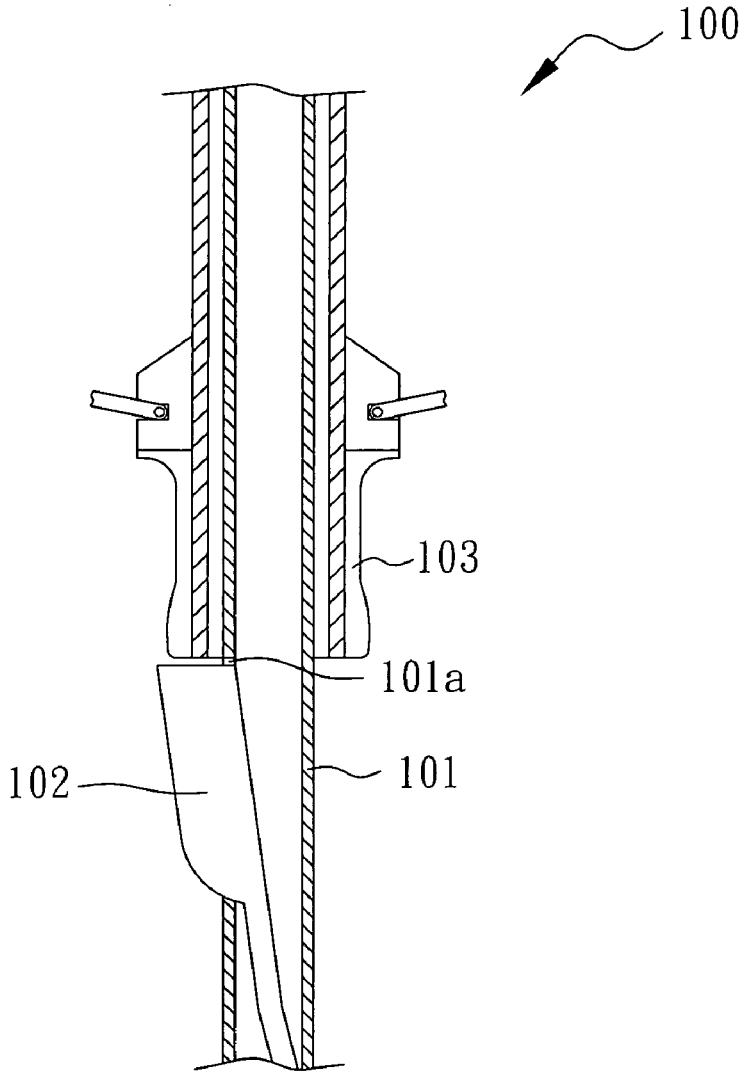
FIG. 9 Prior Art
FIG. 9 is a cross sectional view to show a conventional umbrella.
Figure 10:
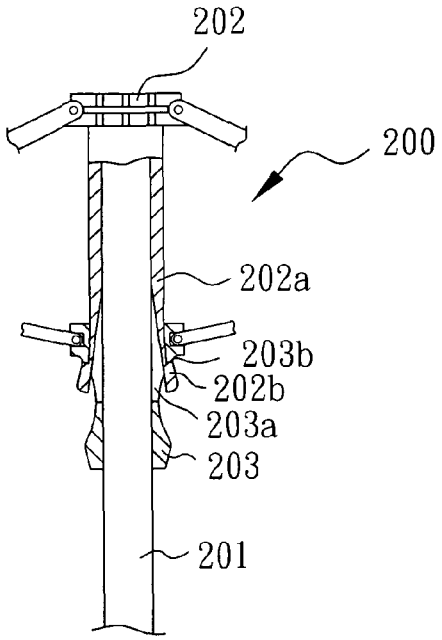
FIG. 10 Prior Art
FIG. 10 is a cross sectional view to show another conventional umbrella.
Figure 11:
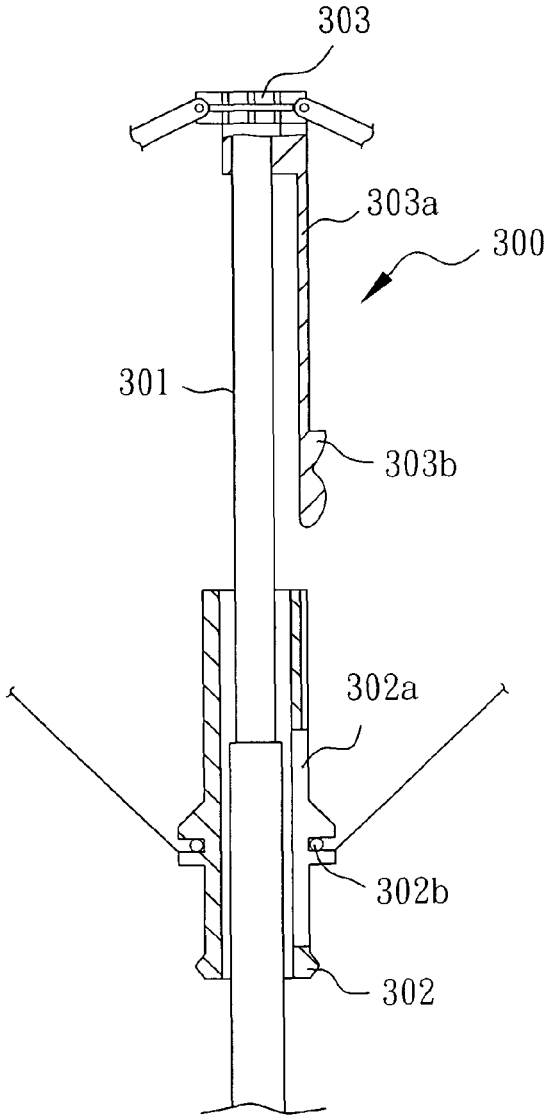
FIG. 11 Prior Art
FIG. 11 is a cross sectional view to show yet another conventional umbrella.
Figure 12:
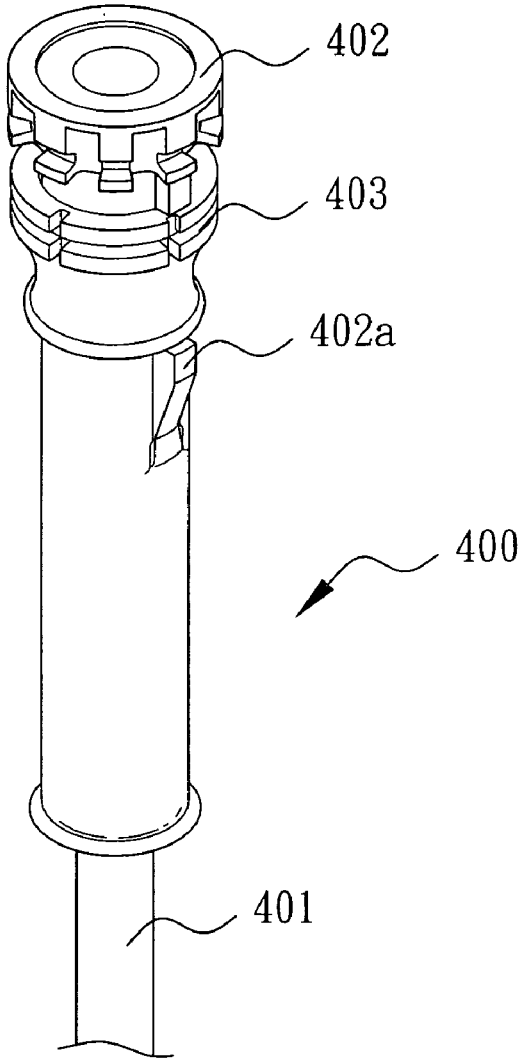
FIG. 12 Prior Art
FIG. 12 is a perspective view to show yet another conventional umbrella.
Figure 13:
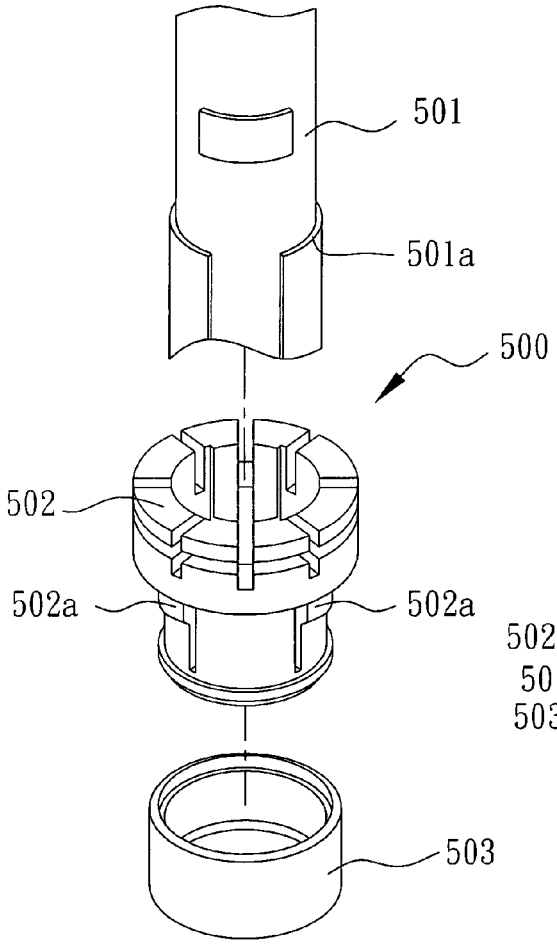
FIG. 13 Prior Art
FIG. 13 is an exploded view to show a conventional operation system of an umbrella.
Figure 14:
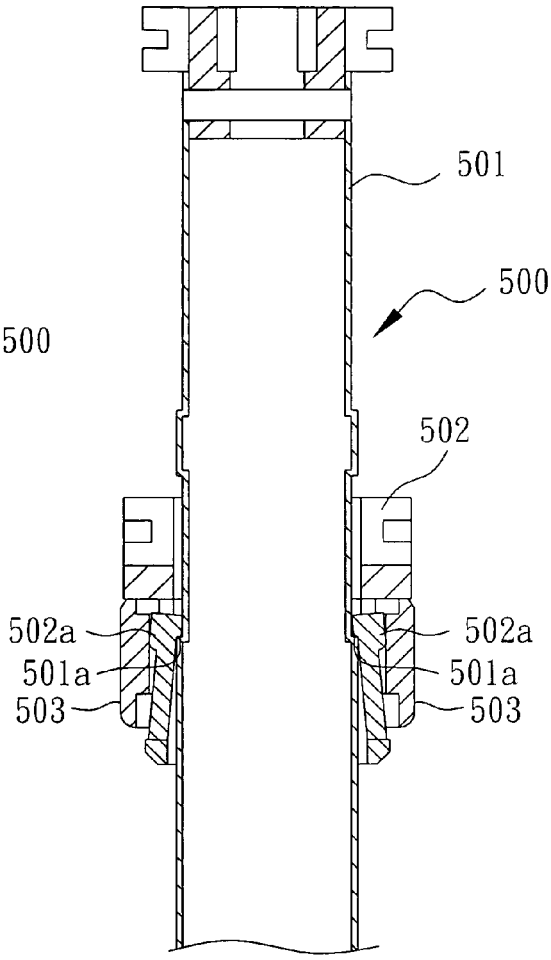
FIG. 14 Prior Art
FIG. 14 is a cross sectional view to show the operation system in FIG. 13.

When folding the umbrella as shown in FIG. 8, the sleeve 4 is pulled downward and the compressing member 41 presses the protrusion 23 inward which is disengaged from the positioning hole 32 so that the runner 3 is able to move downward together with the sleeve 4. Because the boss 421 of the sleeve 4 is engaged with the annular lip 312 of the second extension 31, so that the sleeve 4 can drive the runner 3 and be moved away from the top cap 2. The positioning beads 61 and the positioning member 62 are disengaged from the positioning holes 8*a*, 8*b*. Therefore, the umbrella can be folded.

Accordingly, when opening the umbrella, the user simply moves the sleeve 4 to drive the runner 3 to move along the shaft 1 until the protrusion 23 is engaged with the positioning hole 32. The operation is safe and easy.

When folding the umbrella, the sleeve 4 is pulled downward to release the protrusion 23 to allow the runner 3 to move downward. During the action, the user's finger cannot be injured and the strength of the shaft 1 is maintained.

While we have shown and described the embodiment in accordance with the present invention, it should be clear to those skilled in the art that further embodiments may be made without departing from the scope of the present invention.

What is claimed is:

1. An operation system for umbrellas, comprising:

a shaft including multiple sections, a top cap connected to a top of the shaft, the top cap having a first extension extending downward therefrom and the first extension having a flexible part formed thereto, a gap defined between the flexible part and a wall of the first extension, a protrusion extending from a distal end of the flexible part, the first extension having a guide member protruding axially from an outer periphery thereof and the guide member located above the protrusion of the flexible part;

a runner movably mounted to the shaft and the first extension, the runner having a second extension extending downward therefrom, a positioning hole defined through a wall of the second extension and the protrusion being engaged with the positioning hole to stop the runner from moving downward, the second extension having a guide slot defined therein which receives the guide member to guide the runner to move linearly, and a hollow sleeve movably mounted to the second extension and driving the runner to move along the shaft, the sleeve having a first open end and a second open end which is wider than the first open end, the sleeve has a tapered passage defined therethrough which communicates with the first and second open ends, the sleeve having a compressing member located at an inner periphery thereof and located close to the first open end so as to compress the protrusion inward to disengage the protrusion from the positioning hole.

2. The operation system as claimed in claim 1, wherein the flexible part is integrally formed with the first extension and the gap is a U-shaped gap.

3. The operation system as claimed in claim 1, wherein the first open end of the sleeve includes a boss on an end surface thereof and the second extension has an annular lip on an underside thereof, the annular lip is engaged with the boss when the sleeve is moved downward so that the sleeve is not disengaged from the second extension.

4. The operation system as claimed in claim 1, wherein the compressing member of the sleeve is a stepped shoulder.

5. The operation system as claimed in claim 1, wherein the shaft includes a passage defined therethrough.

6. The operation system as claimed in claim 5, wherein the shaft includes a first section and a second section, a first end piece is inserted into the first section and has a reception hole, a spring is located in the reception hole and two positioning beads are located on two ends of the spring, each of the first and second sections includes positioning holes, the two positioning beads are removably engaged with the positioning holes.

7. The operation system as claimed in claim 6, wherein the positioning beads are two steel beads.

8. The operation system as claimed in claim 5, wherein the shaft includes a first section and a second section, a first end piece is inserted into the first section and has a reception hole, a spring is located in the reception hole and a positioning member is located at one end of the spring, each of the first and second sections includes positioning holes, the positioning member is removably engaged with the positioning holes.

9. The operation system as claimed in claim 8, wherein each of the first and second sections has a groove axially defined in an outer surface thereof and a through hole is defined through a wall of the first section and a stop member is engaged with the through hole, the stop member prevents the first and second sections from being separated from each other.

10. The operation system as claimed in claim 8, wherein the positioning member is an elongate member.

* * * * *